United States Patent [19]

Desom

[11] 4,312,168

[45] Jan. 26, 1982

[54] METHOD AND DEVICE FOR PRESSING AND PLEATING OVERCAPPING CAPS OF THE FOIL TYPE ONTO BOTTLE NECKS

[76] Inventor: Albert Desom, 5, route de Stadtbredimus, Remich sur Moselle, Luxembourg

[21] Appl. No.: 109,918

[22] Filed: Jan. 7, 1980

[30] Foreign Application Priority Data

Jan. 13, 1979 [DE] Fed. Rep. of Germany ..... 2901169

[51] Int. Cl.[3] ..... B67B 5/00; B67B 3/12; B67B 3/16

[52] U.S. Cl. ..... 53/49; 53/345; 53/348; 53/361; 53/333

[58] Field of Search ..... 53/49, 345, 397, 348, 53/361, 329, 488, 333

[56] References Cited

U.S. PATENT DOCUMENTS

| | | | |
|---|---|---|---|
| 2,202,181 | 5/1940 | West | 53/361 X |
| 2,320,515 | 6/1943 | Engle | 53/361 |
| 2,891,366 | 6/1959 | Stover | 53/361 |
| 3,039,250 | 6/1962 | Pancrazi | 53/329 |

FOREIGN PATENT DOCUMENTS

| | | | |
|---|---|---|---|
| 78942 | 3/1932 | Sweden | 53/361 |
| 28826 | of 1910 | United Kingdom | 53/361 |

*Primary Examiner*—Horace M. Culver

*Attorney, Agent, or Firm*—Cushman, Darby & Cushman

[57] ABSTRACT

The device comprises a first pair of pressure chambers, the facing inner walls of which are provided with contoured pleating pads, and a second pair or pressure chambers, the facing inner walls of which are provided with contoured pressing and lapping pads, each said pad being outwardly shaped to substantially correspond to the shape of a bottle neck. The pleating pads have a substantially constant thickness when the pressing and lapping pads have lateral end portions of a greater thickness than the mid-portion thereof. The method comprises the step of first pressure applying the pleating pads, then the pressing and lapping pads to tightly press the cap onto the bottle neck with formation of two symmetrical pairs of outwardly extending pleats, to retract all the pads and to bring back the pressing and lapping pads into pressure contact against the neck to cause said lateral end portions thereof to overflow around the bottle neck, thereby to fold or lap over the thus formed pleats.

The apparatus is more particularly useful for overcapping champagne or sparkling wine bottles.

7 Claims, 11 Drawing Figures

Fig. 1
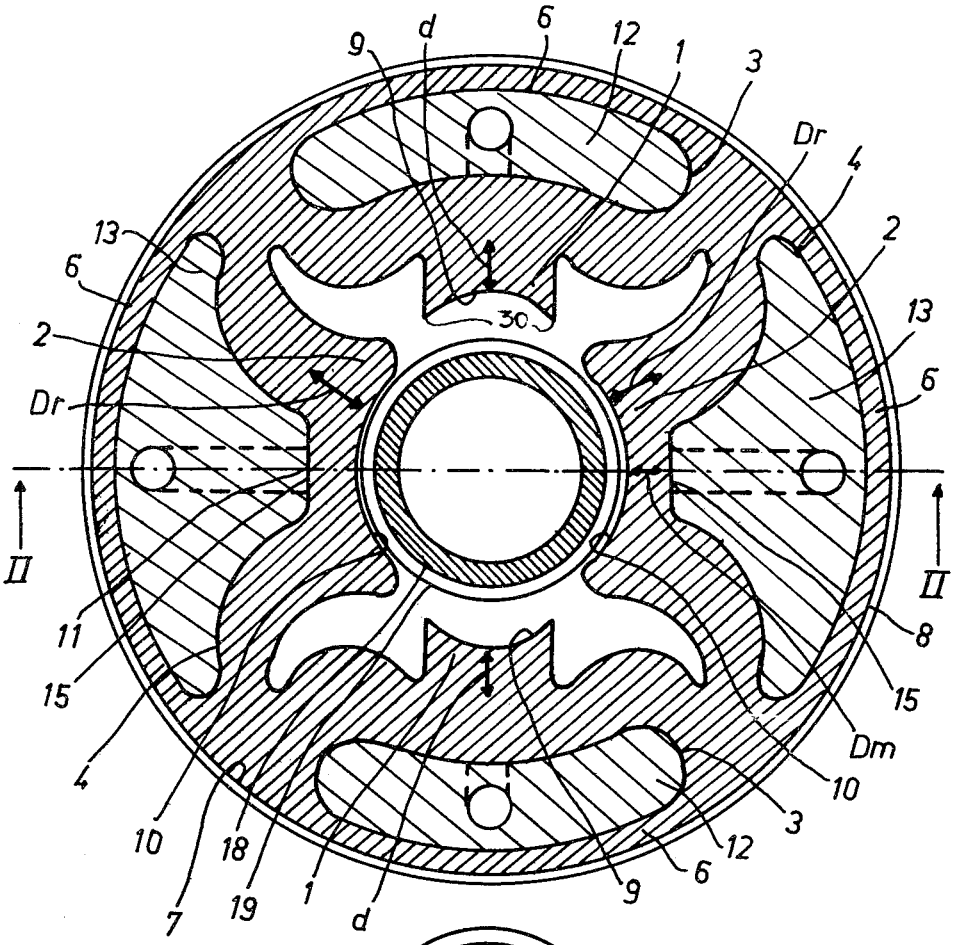
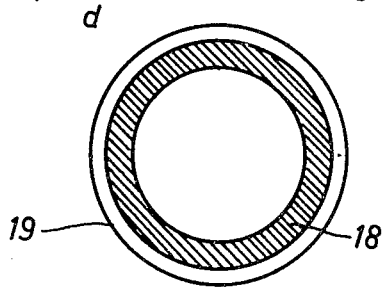
Fig. 3

Fig. 6
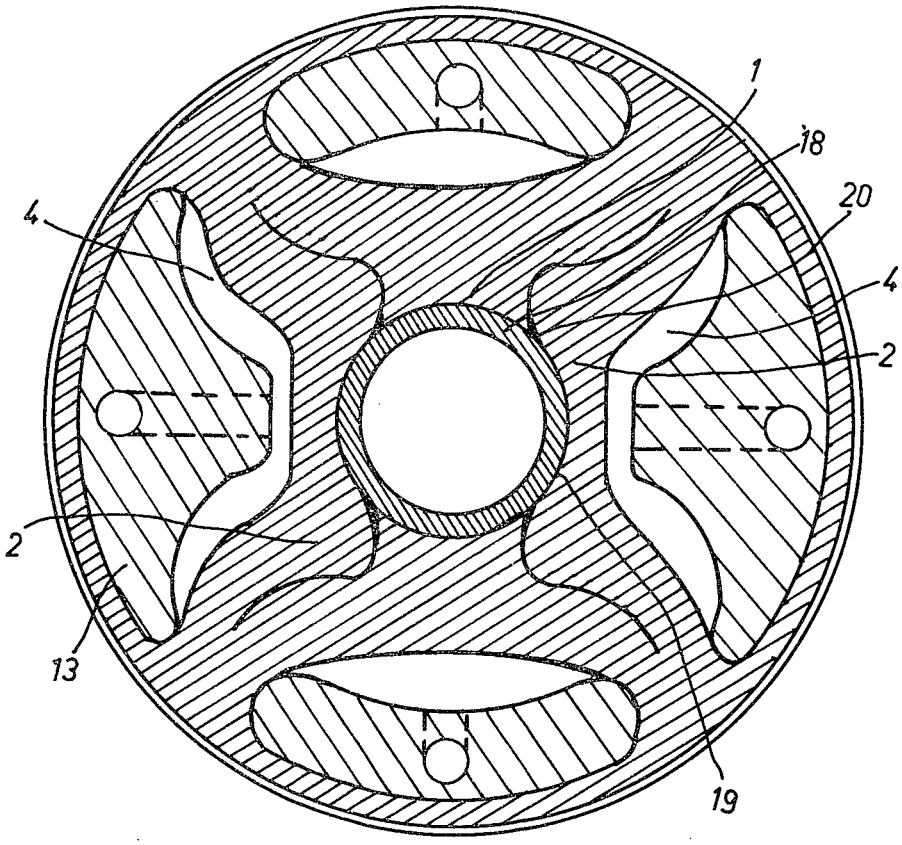
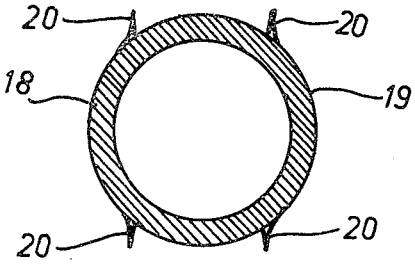
Fig. 7

Fig. 8
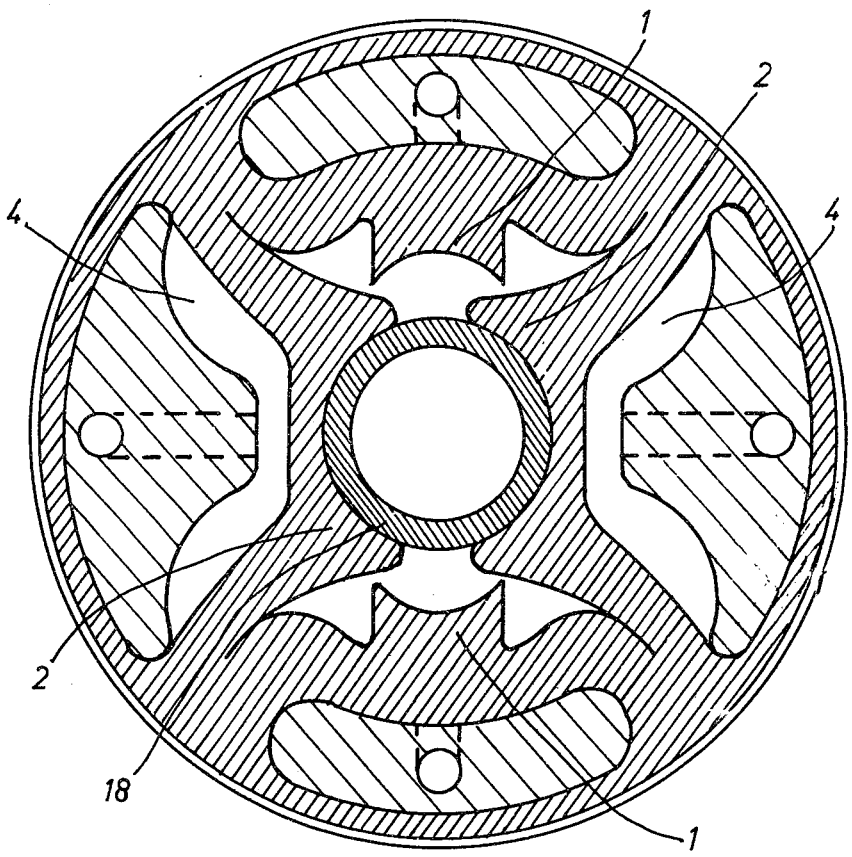
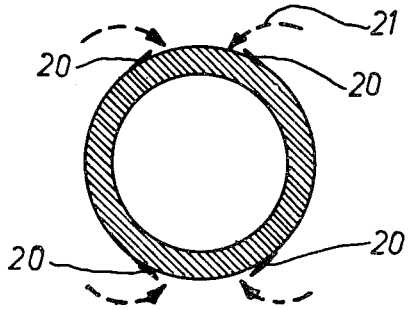
Fig. 9

METHOD AND DEVICE FOR PRESSING AND PLEATING OVERCAPPING CAPS OF THE FOIL TYPE ONTO BOTTLE NECKS

BACKGROUND AND SUMMARY OF THE INVENTION

The present invention relates to a method and a device for pressure applying overcapping caps of the foil type onto a bottle neck and for pleating and lapping over the pleats of said pressed caps onto said bottle neck, more particularly for champagne or sparkling-wine bottles.

DESCRIPTION OF THE PRIOR ART

Fluid actuated foiling or capping devices have been developed to overcome the drawbacks in complexity and weakness of the conventional mechanical pressing and pleating devices, which comprise a series of pressure chambers which are simultaneously fed with a fluid under pressure to cause the inner walls of said chambers to expand one towards the other so as to come into pressure contact with a bottle cap of the foil type loosely disposed on a bottle neck received in the device. The inner wall of each chamber thus abuts laterally against the inner walls of the adjacent chambers, so as the central portions of said inner walls come into tightly pressure contact with the bottle necks, whereby tightly pressing the cap onto the neck while defining pleats which will be lapped over or smoothed in a further step.

The experiments have shown that such devices do not ensure a convenient and stable pleating of the caps generally, and do not permit to correctly pleat or even to pleat a cap made out of a relatively rigid foil or out of a foil showing a relative thickness. The inner walls of the pressure chambers, which are identical and relatively thin for achieving a quite large expansion under pressure, show themselves at the beginning of the expansion by a fluid under pressure a very low rigidity which does not permit to transmit a sufficient pressure onto a relatively thick cap to form on said latter pleats at perfectly determined and stable positions, the caps being generally pressed onto the bottle neck with formation of numerous ondulations or corrugated ridges, whereby furnishing a final unattractive aspect for the pressed cap which affects greatly the legibility of the indications, marks or labels usually printed onto said cap. In addition, said devices are relatively fragile with respect to overpressures and show a low operational reliability.

There are also known devices embodying contoured pads which are displacable two by two in mutually perpendicular diametral directions for pressing a cap onto a bottle neck and thereby forming, on the periphery of the neck, several pleats extending outwardly. In such devices, however, said pleats have to be lapped over and pressed or smoothed onto the bottle neck in an additional further pressing station, with the corresponding drawbacks in operation costs and in positioning or orientating the bottles in the successive stations.

SUMMARY OF THE INVENTION

The object of the present invention is to provide a device which permits, in a single treatment station, to successively realize the pressing of the cap with formation of pleats, and then the lapping over or smoothing of said pleats in a reliable and precise manner, at high operating rates even for a relatively wide range of dimensions or tolerances of the bottle necks or of the caps to be utilized, as also for a wide range of different shapes of bottle necks or overcapping caps.

In accordance with the present invention, the apparatus comprises two mutually perpendicular pairs of adjacent pressure chambers wherein on the diametrally opposed inner walls of the first pair of pressure chambers are formed pleating pads which are shaped outwardly to substantially correspond to the shape of a bottle neck and, on the diametrally opposed inner walls of the other pair of pressure chambers angularly offset of the preceeding pair of pressure chambers are formed pressing and lapping pads which are outwardly shaped to substantially correspond to the shape of a bottle neck.

According to a feature of the invention, the facing pressing and lapping pads each has, in transversal cross-section, a thickness which is lower in the vicinity of the central zone of its pressure applying surface than the adjacent lateral end portions of said applying surface. According to another feature of the invention, the facing pleating pads each has a substantially constant thickness along the width of its pressure applying surface.

According to a yet another feature of the invention, the device comprises four unitary pressure chambers arranged adjacent each other in a rigid frame so as to define between the pressure applying surfaces of the different pads a central passage having, in a longitudinal cross-section perpendicular to a transversal cross-section, an evolutive configuration corresponding substantially to the flared shape of the bottle necks to be capped.

Other objects and advantages of the invention will become apparent upon consideration of the present disclosure in its entirity.

BRIEF DESCRIPTION OF THE DRAWINGS

FIG. 1 schematically shows, in a transversal cross-section and in a rest condition, a device for pressing, pleating and lapping over an overcapping cap onto a bottle neck according to the invention;

FIG. 3 is a transversal cross-section of a bottle neck onto which a cap has been loosely positioned in the preliminary pressing step corresponding to FIG. 1;

FIG. 6 is a view similar to FIG. 4 but showing the further step of application of the pressing and pleating pads;

FIG. 7 is a view similar to FIG. 5 showing the cap as pressed onto the bottle neck after the step of FIG. 6 and showing the thus formed pleats;

FIG. 8 is a view similar to FIG. 6 showing the further step of lapping over the pleats after retraction of the pleating pads;

FIG. 9 is a view similar to FIG. 7 emphasizing the folding or lapping over of the pleats;

DETAILED DESCRIPTION OF THE INVENTION

Figure 2:
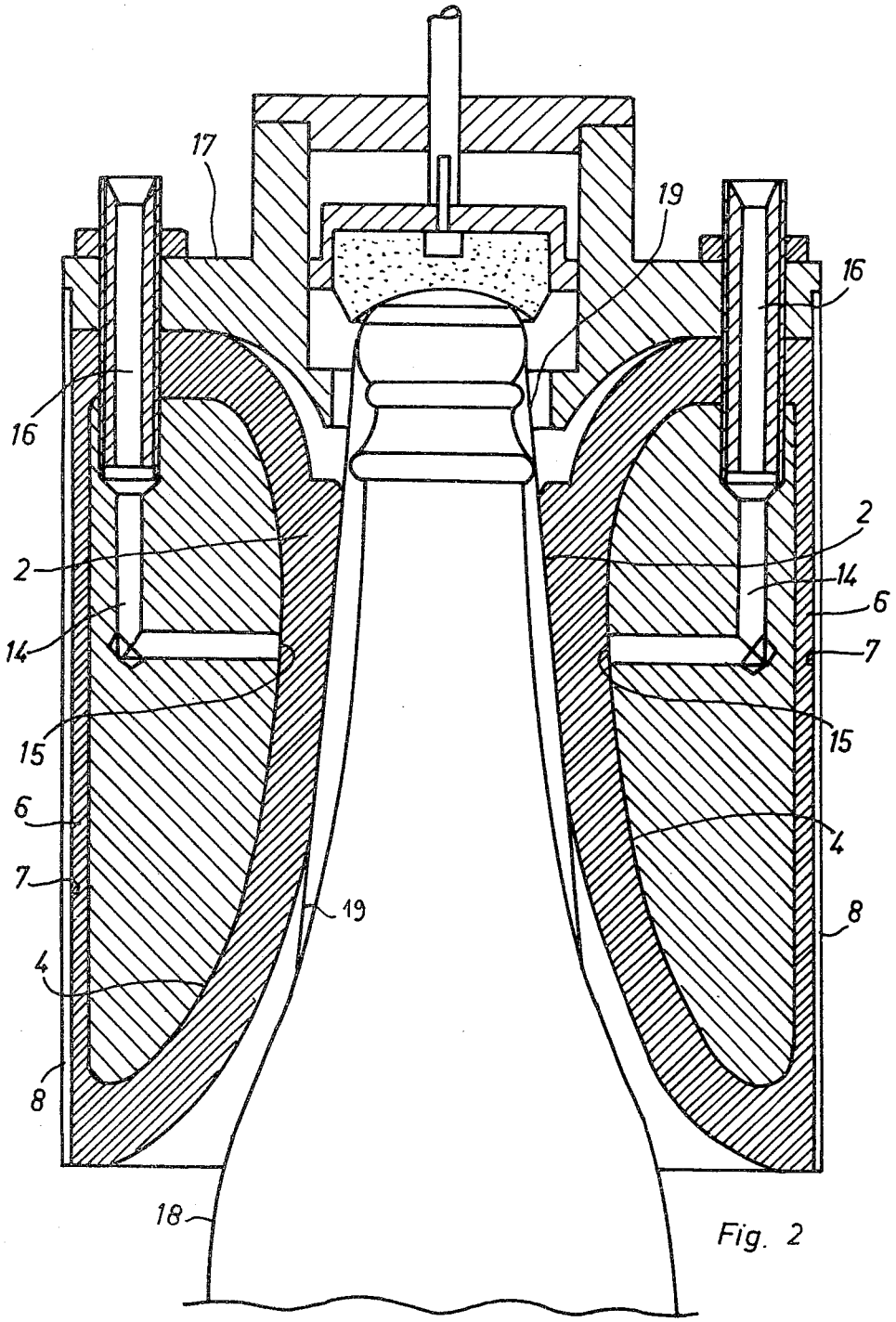
FIG. 2 is a longitudinal cross-section of the device of FIG. 1, in the same rest condition.

In the embodiment shown in FIGS. 1 to 8, the device of the invention comprises a pair of diametrally opposed pleating pads 1, and, offset from 90° with respect to said pads, a pair of diametrally opposed pressing and lapping pads 2, said pads being each formed integrally on the flexible, resilient inner wall of corresponding mutually adjacent pressure chambers 3 and 4, respectively. The outer walls 6 of the pressure chambers opposite to the respective pads 1 and 2 are in bearing contact against the inner surface 7 of a tubular structure 8 forming a frame encompassing the pressure chambers.

The resilient pleating pads 1 have, in transversal cross-section substantially the same thickness along the width of their facing pressure applying surfaces 9. The pressure chambers 3 associated to said pleating pads 1 have each a transversal cross-section substantially mating the curvature of the tubular structure frame 8.

The resilient pressing and lapping pads 2 have in transversal cross-section a thickness D varying along the evolute midline of their pressure applying surfaces 10. Each pad 2 presents, at the middle zone of said pressure applying surface 10 a reduced thickness Dm and, at the lateral end portions of said pressure applying surface, a thickened section Dr. The pressure chambers 4 associated to the pads 2 have a general shape mating substantially the curvature of the cylindrical encompassing structure 8 with a transversal cross-section substantially triangular having an inner angle portion forming a wedge 11 which extends inwardly towards the longitudinal axis of the device to define the middle portion of reduced thickness of the pressing and lapping pads 2. The pads 1 and 2 as also the walls of the pressure chambers 3 and 4 are realized out of a resilient flexible expandable plastic material, all said integers being integrally molded in a single piece in the embodiment shown in FIG. 1. The adjacent portions of the inner walls delimitating the pressure chambers 3 and 4 thus are mutually interconnected, as also the outer walls of the chambers which are retained in bearing contact against the inner surface 7 of the cylindrical structure forming a frame 8.

In the pressure chambers 3 and 4 are arranged solid cores 12 and 13 having the above mentioned configuration for the pressure chambers in their rest position, whereby said walls of said chambers are lying in said rest position on the outer surface of said cores 12 and 13 as illustrated in FIG. 1, in such a manner that the effective inner space within said pressure chambers is substantially totally filled by said cores in said condition. In each core is formed at least a fluid delivering conduit 14 which opens by an opening 15 in the corresponding chamber 3 or 4 at the level of the inner surfaces of the pads 1 or 2. Said conduits 14 are connected to fluid under pressure feeding conduits 16 opening outwardly of said chambers while transversing passive zones of the walls of said pressure chambers, as illustrated in FIG. 2. In the embodiment shown in FIG. 2, the fluid pressure feeding conduits 16 are mounted in a cover 17 extending over the upper end of the cylindrical structure 8 and fastened thereto, said feeding conduits 16 being arranged for connection to a fluid under pressure system (not shown), more particularly an air fluid system.

The cores 12 and 13 initially serve as molding cores for manufacturing the pressure chambers having formed integrally therewith the pleating and pressing-/lapping pads, for instance by hollow casting, injection or vaporization of a resilient plastic material, such as a resilient rubber, preferably natural rubber.

Figure 10:
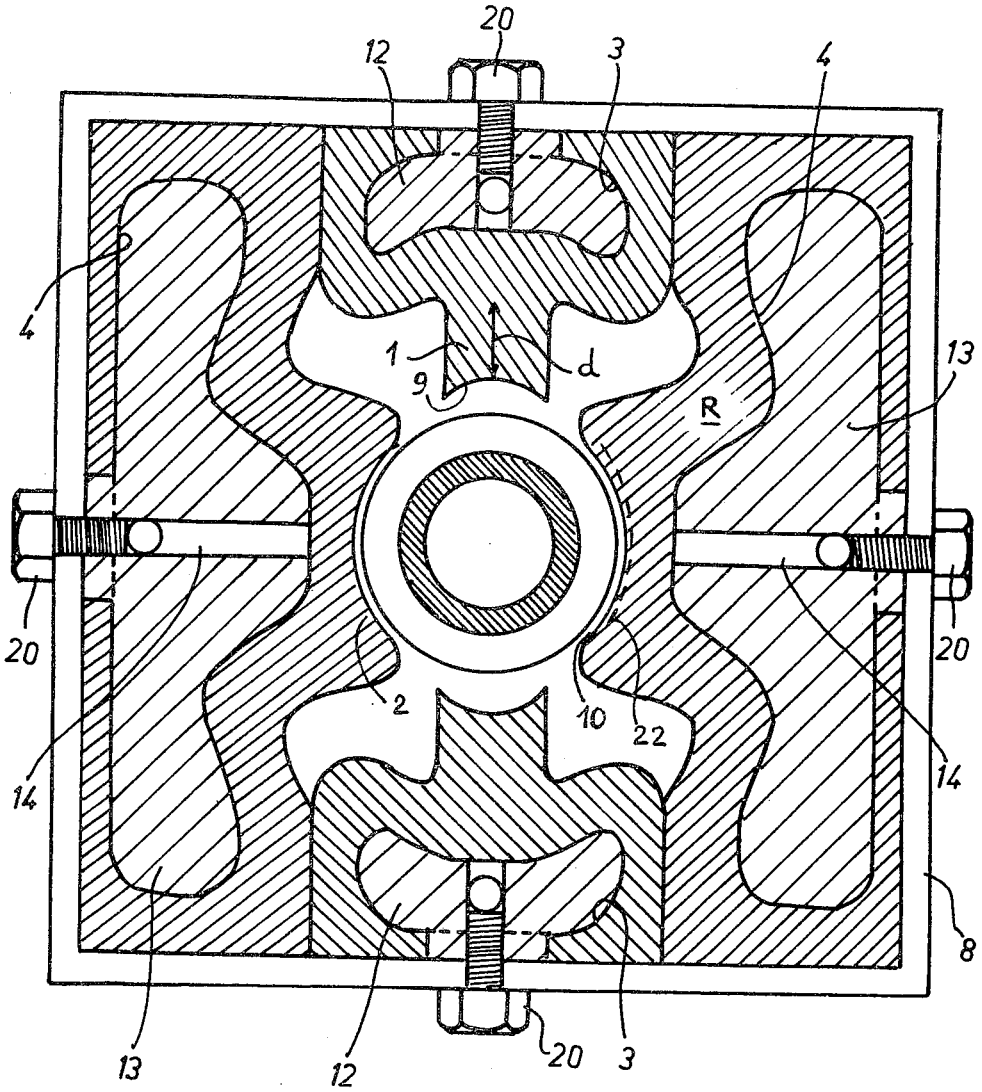
FIG. 10 is a view similar to FIG. 1 showing a preferred embodiment of the device of the invention.
Figure 11:
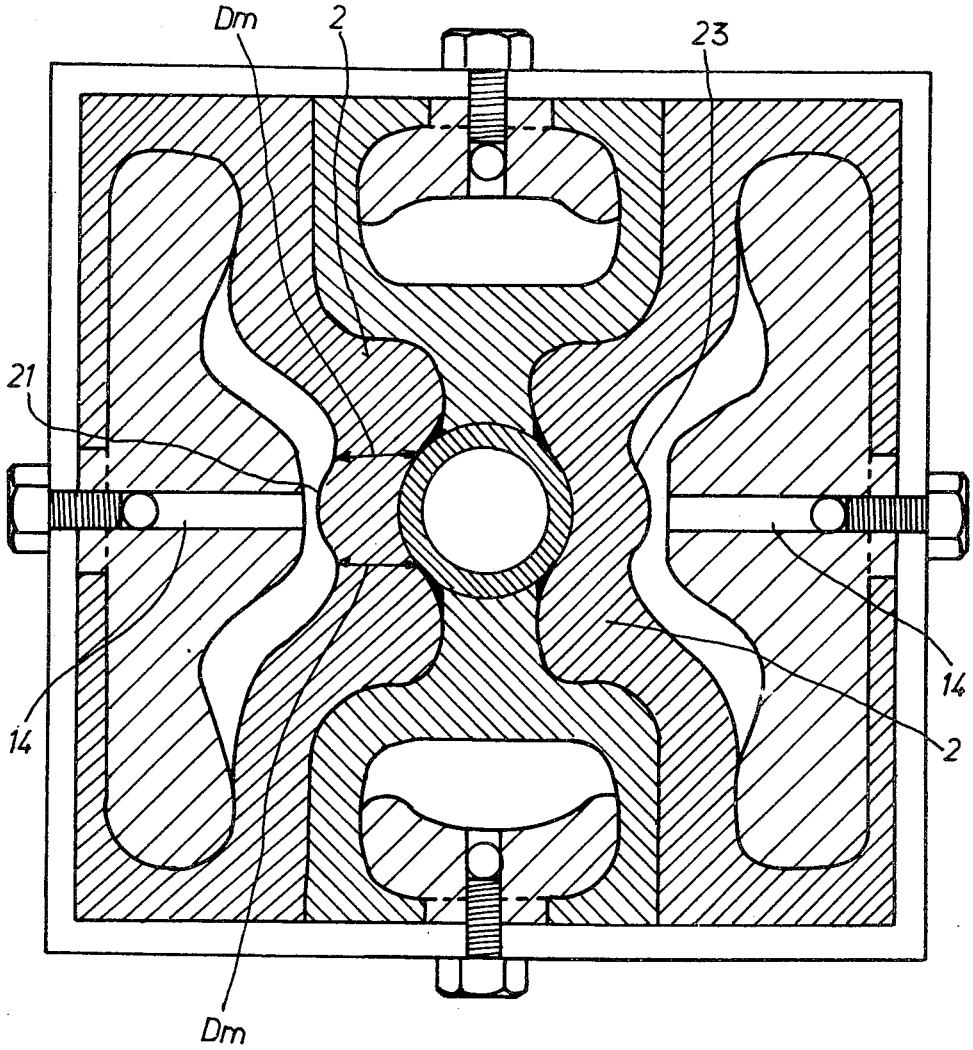
FIG. 11 is a view similar to FIG. 10 but showing the device in the condition of pressing the entirity of the cap with formation of pleats corresponding to the step illustrated in FIG. 6 with respect to the preceeding embodiment.

In the preferred embodiment shown in FIGS. 10 and 11, the encompassing structure forming a frame 8 has a substantially parallelepipedic shape of a square cross-section, the different pressure chambers 3 and 4 being independant and realized as unitary assemblies around their respective inner cores 12 and 13. Said cores are formed here with a back surface at least substantially flat for bearing mounting against the inner surfaces of the frame 8 by means of locking screws 20 each received within an outwardly offset shouldered or embossed portion of said back surface of said cores which abuts directly in bearing contact against the adjacent inner surface of the frame 8, whereby the main portions of said back surface inwardly offset from said shouldered portion serves to fasten by pressure pinching the outer wall portions of the pressure chambers against the frame 8. As in the preceeding embodiment, the mounting screws 20 may be advantageously utilized to define a portion of the pressure under fluid feeding conduits or, as illustrated in FIGS. 10 and 11, as obturating caps for the drilling bores of the delivering conduits 14 extending through the cores.

In the embodiment illustrated in FIG. 11, the pleating pads 2 have, at the middle portion thereof, a slightly thickened inwardly convex portion 21 separating two portions of reduced thickness Dm. In said embodiment, as in the embodiment illustrated in FIGS. 1 to 9 and 10, there will be advantageously provided a flexible renforcing member 22, such as a metallic laminate or a textile band, embedded under the pressure applying surface 10 of the pressing and lapping pads 2.

Figure 4:
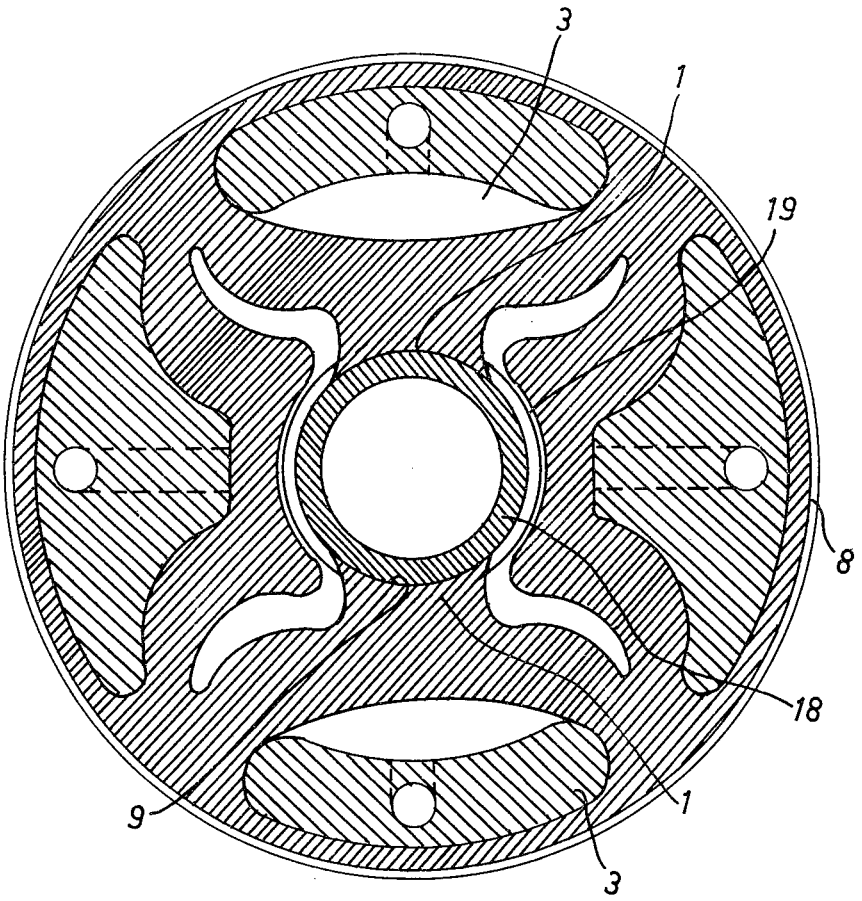
FIG. 4 is a view similar to FIG. 1 illustrating the first step of application of the pleating pads.
Figure 5:
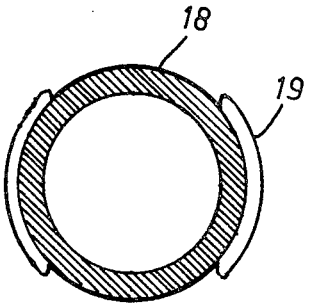
FIG. 5 is a view similar to FIG. 3 showing the cap partially applied onto the bottle neck further to the step illustrated in FIG. 4.

Operation of the device according to the invention will now be detailed in relation with the successive steps illustrated in FIGS. 1, 4, 6 and 8. In the rest condition, i.e with the pressure chambers free from inner overpressure, the inner walls carrying the pads 1 and 2 closely lie on the respective cores 12 and 13, whereby the facing pressure applying surfaces 9, respectively 10, of the pads 1 and 2 define, at the center of the device, a passage having an evolutive flared shape converging upwardly and corresponding substantially to the outer contour of a preformed cap-shaped cap of the foil type 19 loosely disposed on the neck of a yet corked bottle, as illustrated in FIG. 2, the cork being eventually retained by a cork-wiring. The fluid, e.g. air under pressure is thus introduced in the pair of conjugate pressure chambers 3 corresponding to the pleating pads 1 to bring said latter into pressure contact against the bottle neck while tightly pressing the cap onto said latter with the lateral cants 30 of the pad which deliminate the pressure applying surface 9 thereof realizing an inner beginning of pleats as better shown in FIGS. 4 and 5. As shown in FIG. 4, during said first applying step, the pleating pads 1 are only very slightly distored due to their relative important thickness d.

As illustrated in FIG. 6, with the pleating pads 1 retained applied onto the bottle neck, the fluid under pressure is in a second step also introduced in the other pair of conjugate pressure chambers 4 corresponding to the pleating/lapping pads 2 to bring same into pressure contact against the bottle neck, whereby pressing the remaining non-pressed portions of the cap 19 against the bottle neck while simultaneously forming outwardly extending pleats 20 at the level of the contact zones between the contacting adjacent lateral portions of the pressing-lapping pads 2 and the pleating pads 1. In a third stop, pressure is successively released from pressure chambers 3 and 4, whereby the whole set of pads 1 and 2 are brought back toward their rest position of FIG. 1, the cap 19 on the bottle neck being in the configuration illustrated in FIG. 7, i.e. tightly and uniformly pressed against the whole periphery of the bottle neck with the exception of the narrow zones of the pleats 20 which are accurately symetrically formed in the desired positions on the periphery of the bottle neck.

In a further step, the pressure chambers 4 of the pressing and lapping pads 2 are again fed with the fluid under pressure to bring back the pads 2 into pressure contact against the bottle neck 18, the pleating pads 1 being retained set back. Due to the extra-thickness Dr of the lateral portions of the pressing and lapping pads 2 and due to the reserve of elastic material R (FIG. 10) constituted by the junction zones between said lateral portions of the pads 2 and the main body of the corresponding pressure chamber 4, said lateral ends of the pads 2 are allowed to further distort to overlap in a larger extent the periphery of the bottle neck to reach the position shown in FIG. 8, i.e. beyond the pleating zones 20 of the cap thereby to controllably fold said pleats onto the bottle neck and lapping over same as indicated by the arrows 21 on FIG. 9. Said overlapping or overflowing expansion of the pressing and lapping pads 2 round the bottle neck is enhanced, in addition to the above mentioned reserve of the resilient material R, by the substantially trapezoidal or triangular shape of the inner walls of the associated pressure chambers carrying said pads and by the central zone of reduced thickness of said pads. In the embodiment of FIG. 11, the extra-thickness 23 and/or the flexible reinforcing element 22 allows for a more uniform pressure application of the pressing and lapping pads 2 while restricting the amplitude of the overlapping extension of the lateral edge portions of said pads around the bottle neck, whereby limiting the possibilities of sliding rotational displacement of the cap pressed onto the bottle neck. An important feature of the invention resides in the fact that said overflowing of the lateral portions of the pressing and lapping pads is obtained substantially without proper expansion of the inner wall of the pressure chamber as a result of a pivoting displacement of the thickened portion Dr and of the reserve of resilient material R about the lateral end portions of the central portion of reduced thickness Dm of the pressing and lapping pads. The successive expansion and contraction movement are thus achieved without inducing any noticeable internal strain in the material of the wall of the pressure chambers 4, whereby ensuring increased operation life and improved reliability of the device.

In addition to the simplicity in use and to the reliability of the device of the invention, said device allows to receive bottle necks having different diameters. In a practical embodiment, the device being designed for a nominal diameter of bottle neck of 32 mm, said device may be operated with bottle necks having diameters varying between about 25 and 40 mm with actuating pressures comprised between about 2 and 4 bars. The device of the invention further presents an improved safety against eventual bursting due to over-pressures in the pressure chambers without a bottle neck introduced in the central passage, contrarily to the existing devices.

While the present invention has been described as embodying specific means, it will be understood that other variations may be adapted without departing from the field and proper scope of the appendent claims.

What I claim is:

1. A device for pressing and pleating an overcapping foil cap on a bottle neck, comprising:

a rigid encompassing frame;

means defining first and second pairs of diametrically opposed pressure expandable chambers disposed within said frame and arranged to define a central passage for receiving a bottle neck, each of said chambers comprising at least an inner expandable resilient wall defining, integral therewith, a pad having an operative surface defining partially said central passage and shaped, in a rest condition, to substantially correspond to the partial shape in longitudinal and transversal directions of a bottle neck;

a first means for admitting simultaneously pressurized fluid into the chambers of said first pair for pressing the pads thereof onto the bottle neck;

a second means, independent of said first means, for admitting simultaneously pressurized fluid into the chambers of said second pair for pressing the pads thereof onto the bottle neck, the pads of said first pair having, in transversal cross-section, a substantially constant thickness along their operative surfaces which is delineated laterally by substantially angular edges to initiate pleat formation in a cap when pressed onto a bottle neck, the pads of said second pair having, in transversal cross-section, a middle portion having a thickness along their operative surfaces less than that of the opposite lateral end portions thereof which delineate their operative surfaces, whereby said lateral end portions may expandably circumferentially overlap the area of a bottle neck pressed by the pads of said first pair when the pads of said second pair are pressed onto said bottle neck with the pads of said first pair separated therefrom so as to lap the pleats previously formed in said caps by the pads of said first pair.

2. The device of claim 1, wherein each chamber of the second pair has a substantially triangular configuration in transversal cross-section in rest condition with an angular portion extending inwardly toward the passage.

3. The device of claim 2, wherein each chamber comprises a wall opposite to the corresponding pad, said opposite wall being engaged with an inner surface of a rigid structure forming the encompassing frame.

4. The device of claim 3, wherein a shaped core is disposed in each chamber against which rests in a rest condition the inner wall of said chamber.

5. The device of claim 4, further comprising a fluid pressure conduit extending through each core.

6. The device of claim 5, wherein each core is rigidly connected to the rigid structure.

7. The device of claim 6, wherein the cores are shaped generally in accordance with the shape in the longitudinal and transversal directions of a bottle neck.

* * * * *